US011796289B1

(12) United States Patent
Coon et al.

(10) Patent No.: US 11,796,289 B1
(45) Date of Patent: Oct. 24, 2023

(54) TARGET PRACTICE DEVICE

(71) Applicants: Ashley Kendall Coon, Gallatin, TN (US); Chad Isaac Coon, San Diego, CA (US)

(72) Inventors: Ashley Kendall Coon, Gallatin, TN (US); Chad Isaac Coon, San Diego, CA (US)

( * ) Notice: Subject to any disclaimer, the term of this patent is extended or adjusted under 35 U.S.C. 154(b) by 15 days.

(21) Appl. No.: 17/379,005

(22) Filed: Jul. 19, 2021

(51) Int. Cl.
*F41J 7/04* (2006.01)
*F41J 5/14* (2006.01)

(52) U.S. Cl.
CPC .. *F41J 7/04* (2013.01); *F41J 5/14* (2013.01)

(58) Field of Classification Search
CPC . F41J 5/00; F41J 5/04; F41J 5/14; F41J 5/24; F41J 5/052–056; F41J 5/205; F41J 7/02; F41J 7/04; F41J 9/02
USPC ..... 273/393
See application file for complete search history.

(56) References Cited

U.S. PATENT DOCUMENTS 5,222,741 A * 6/1993 Redl ..... F41J 7/04 273/393
7,556,268 B2 * 7/2009 Bateman ..... F41J 7/06 273/406
9,457,252 B2 * 10/2016 Schwarz ..... A63B 69/0075
10,048,045 B2 * 8/2018 Graham ..... F41J 5/04
10,113,841 B2 * 10/2018 Foley ..... F41J 7/04
2008/0088089 A1 * 4/2008 Bliehall ..... F41J 9/02 273/359
2009/0194943 A1 * 8/2009 Amitai ..... F41J 5/14 273/371
2015/0362296 A1 * 12/2015 Medendorp ..... F41J 1/10 273/385

* cited by examiner

*Primary Examiner* — Laura Davison
(74) *Attorney, Agent, or Firm* — Schrantz Law Firm, PLLC; Stephen D. Schrantz

(57) ABSTRACT

The target device provides a strike detector attached to an adjustable neck for adjusting the position of the strike detector behind a target. A housing is mounted at a desired location and height. A retention body secures a target to the housing. The target may be a paper target or other target. The retention body can secure different targets to vary the shooter's practice and to change the look that each shooter experiences. The adjustable strike detector allows placement of the strike detector in different positions behind the target to define a customizable strike zone. Upon hitting the strike detector at least once, the target device takes an action to indicate that the strike detector has been hit, such as the retention body releasing the target. The target then falls from the housing. Such releasing of the target notifies the user that the user has struck the strike zone and the strike detector the desired number of times to neutralize the target.

16 Claims, 4 Drawing Sheets

TARGET PRACTICE DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to a target device with an adjustable strike detector. The present invention directs the shooter to aim towards a specific area of a target. The strike detector is positioned behind a target to define a strike zone of the target. Upon striking the strike detector at least once, the present invention releases the target to confirm that the user has hit the strike zone defined by the strike detector.

II. Description of the Known Art

Patents and patent applications disclosing relevant information are disclosed below. These patents and patent applications are hereby expressly incorporated by reference in their entirety.

U.S. Pat. No. 10,048,045 issued to Graham et al. on Aug. 14, 2018 ("the '045 patent") teaches an intelligent target comprising a target body suspended from a support structure, at least one sensor affixed to the target body that detects a hit in an area of the target body, a controller, in communication with each sensor, that records the hits detected by the sensor and the area of the target body that was hit and issues a release command when a predetermined number of hits has been reached, and a release mechanism operatively connected with the controller and which releases the target body and allows the body to fall from the support structure on receipt of the release command from the controller.

U.S. Pat. No. 7,556,268 issued to Bateman et al. on Jul. 7, 2009 teaches a drop target that includes a first target seen by a shooter and a second target concealed behind the first target. When the shooter hits the second target, the first target taught by the '268 patent moves, thereby representing that the shooter as hit a desired "kill zone" and should cease shooting.

US Publication No. 20090194943 to Amitai on Aug. 26, 2009 ("the '943 publication") teaches a hit scoring target comprising a target panel connected to a hit scoring management unit. The hit scoring management unit taught by the '943 publication comprises an electromagnetic signature sensor operatively associated with the target panel. The electromagnetic signature sensor taught by the '943 publication may be a capacitance sensor, inductance sensor or magnetic field sensor. The hit scoring management unit taught by the '943 publication further comprises a control unit operatively associated with the electromagnetic sensor. The control unit taught by the '943 publication is arranged to count the number of detected changes in the electromagnetic signature of target panel, and invoke a predetermined action upon reaching a predefined number, wherein each change in the electromagnetic signature of the panel target is associated with a projectile passing through target panel. The '943 publication teaches that the action invoked may be tilting down the target panel or transmitting information relating to the hit scoring on the target panel.

The known art does not allow a simple set up of the target with exchangeable targets. The known art does not allow the user to adjust a strike detector to encourage a user to aim at a specific portion of the target.

SUMMARY OF THE INVENTION

The present invention is useful for accurate and precise shooting. The present invention provides a target device with an adjustable strike detector attached to an adjustable neck. A housing is mounted at a desired location and height. A retention body secures a target to the housing. The target may be a paper target or other target. The retention body can secure various different targets to vary the shooter's practice and to change the look that each shooter experiences.

By securing different targets and a variety of targets, the retention body provides the shooters with different targets to reduce the repetitiveness of the target practice. The retention body secures different targets to stimulate the shooter by varying looks, targets, and strike zones. Attaching different targets avoids repetitiveness and requires the shooter to change the shooter's aim and focus more on the shooter's actions.

The adjustable strike detector allows placement of the strike detector in different positions behind the target. Such adjustability allows changing of different targets. Such adjustability also allows for focusing on different targeted areas of the target. The user simply adjusts the strike detector to a different position behind the target to define a new strike zone.

The strike detector may have different designs and shapes depending on the target practice. To increase the angles of firing, the strike detector may extend backwards from a front surface. The strike detector allows shots from the sides by providing a nonplanar strike detector.

The user aims for the strike zone. Upon hitting the strike zone at least once, the retention body releases the target. The target then falls from the housing. Such releasing of the target notifies the user that the user has struck the target the desired number of times to neutralize the target. The user may then advance to the next target.

It is an object of the present invention to provide a housing that easily mounts to enable customized positioning of the target.

It is another object of the present invention to provide a housing that secures different targets to allow the user to customize the target practice session.

It is another object of the present invention to provide a strike detector hidden behind the target that defines a customizable strike zone.

It is another object of the present invention to provide an action indicating that the user has struck the strike detector and the desired strike zone.

It is another object of the present invention to require one or more hits of the strike detector before taking the action indicating that the target has been neutralized.

It is another object of the present invention to release the target to indicate that the target has been neutralized.

It is another object of the present invention to provide a strike detector that communicates with an actuator that releases the target.

It is another object of the invention to require multiple hits of the strike detector prior to releasing the target.

In addition to the features and advantages of the target practice device according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
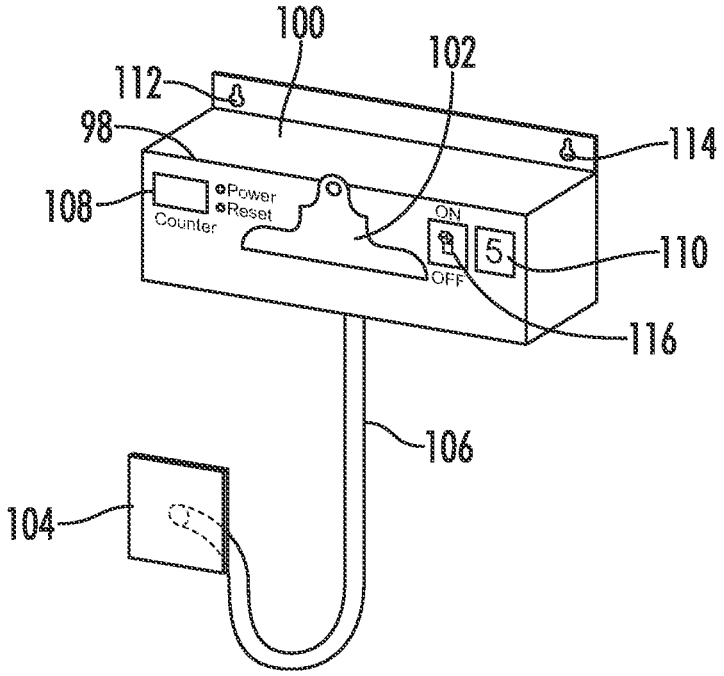
FIG. 1 is a perspective view showing one embodiment of the present invention.

Referring to FIG. 1, the target practice device of the present invention is generally illustrated by reference numeral 100. The target practice device 100 provides a mountable housing 98 that attaches to an elevated structure. The housing 98 may be mounted on a slide, a bullet trap, or other safe area that will allow safe firing of ammunition or other projectiles at the target. The housing 98 provides mounting apertures 112, 114 for mounting the housing 98.

A retention body 102 retains a target on the housing 98. The retention body 102 holds the target. The retention body 102 adjusts between a retain position and a release position. The retention body 102 holds the target while in the retain position. The retention body 102 drops the target when adjusted to the release position. In one embodiment, an actuator positions the retention body 102 in the retain position and the release position. In one embodiment, the retention body 102 is biased to the retain position. The actuator then adjusts the retention body to the release position to release the target.

The housing 98 stores a controller that communicates with a strike detector 104 and the actuator. The controller instructs the actuator to maintain the retention body 102 in the retain position. The controller also instructs the actuator to adjust the retention body 102 to the release position to release the target.

The strike detector 104 communicates with the controller that adjusts the actuator. Upon detecting a projectile, such as a bullet, ammunition, arrow, bb, ball, or other projectile, striking the strike detector 104, the strike detector 104 informs the controller of the strike. In one embodiment, the strike detector 104 sends a communication to the controller informing the controller of the projectile hit on the strike detector 104. In one embodiment, the controller instructs the actuator to release the target upon the first strike of the strike detector by the projectile. In another embodiment, the controller requires multiple hits of the strike detector before releasing the target. In such an embodiment, the controller maintains a strike count indicating the number of times the strike detector detected being hit by a projectile. The controller also maintains an action count that indicates how many strikes are required on the strike detector before the controller instructs the release of the target.

In one embodiment, the user selects the action count required to release the target. In another embodiment, the action count is randomly selected. The controller counts the number of strikes of the strike detector as a strike count. The controller instructs the actuator to release the target when the strike count reaches the action count. The actuator adjusts the retention body from the retain position to the release position to release the target when the strike count reaches the action count.

In one embodiment, the housing displays the strike count on strike counter display 108. The housing also displays the action count required for the retention body to release the target on action count display 110. In one embodiment, the action count display 110 may show the number of strikes left required to release the target. Another embodiment may not provide one or both of the strike counter display 108 and the action count display 110.

The housing also provides a power toggle 116 for powering the device on or off. The housing 98 also provides action count incremental buttons to allow the user to increase or decrease the action count required to release the target.

FIG. 1 also shows the strike detector 104 and the adjustable neck 106. The adjustable neck 106 positions the strike detector 104 in relation to the retention body 102. The strike detector 104 is a sensor that detects projectiles hitting against the strike detector 104. The strike detector 104 communicates with the controller. In one embodiment, a wired communication runs through the neck 106 from the strike detector 104 to the controller and actuator. Another embodiment enables wireless communication between the strike detector 104 and the controller.

In one embodiment, the user is positioned longitudinally from the housing 98, target, and strike detector 104. The retention body 102 and target 118 are positioned longitudinally between the user and the strike detector 104. The user fires the projectile at the target held by the retention body 102. The projectile passes through the target and hits the strike detector 104 longitudinally behind the target or misses the strike detector 104. In one embodiment, the strike detector 104 and neck 106 are positioned longitudinally behind the retention body 102 so that the strike detector 104 is located rearward of the target.

The neck 106 positions the strike detector 104. The neck 106 provides adjustability to position the strike detector 104 and strike zone 120 at the desired location. The neck 106 adjusts to the left, right, forward, backward, up, and down. A first end of the neck 106 attaches to the housing. A second end of the neck 106 attaches to the strike detector 104. The second end of the neck 106 adjusts to change the positioning of the strike detector 104 in relation to the housing 98 and the retention body 102. Adjustment of the second end of the neck 106 allows positioning of the strike detector 104 and the strike zone.

The rigidity of the neck 106 maintains the positioning of the strike detector 104 and the strike zone 120. The neck is sufficiently rigid for adjusting the position of the strike detector 104 and strike zone 120 and maintaining the position of the strike detector 104 and the strike zone 120. In one embodiment, the neck 106 is protected by a protective coating, such as a shield, armor, Kevlar, or other protective agent.

Figure 2:
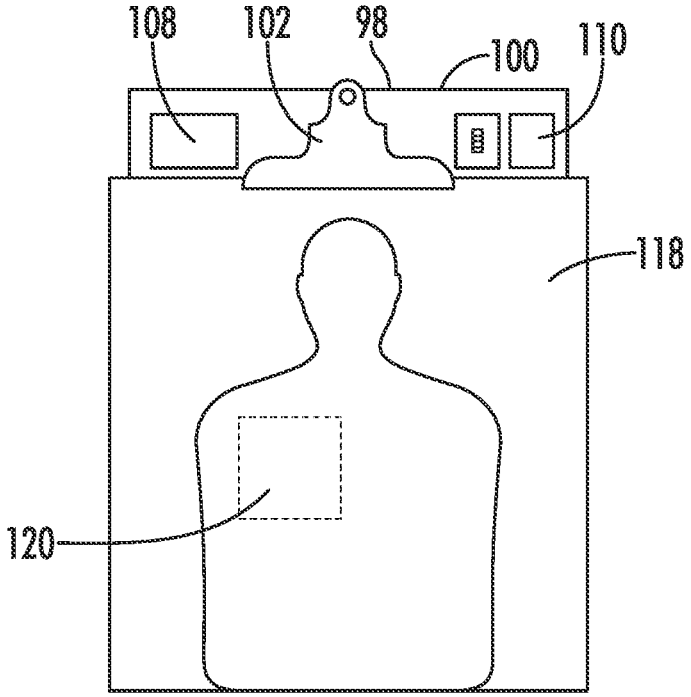
FIG. 2 is an environmental view thereof.
Figure 3:
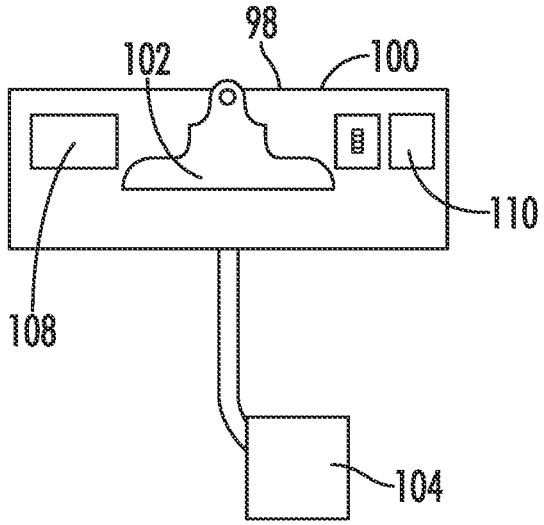
FIG. 3 is a front view thereof.

FIGS. 2 and 3 show an environmental view of the target 118 attached to the housing at the retention body 102 and a front view of the housing 98 with the target 118 removed. The retention body 102 secures the target 118 to the housing. The retention body 102 in the retain position shown in FIGS. 2 and 4 holds the target 118. The retention body 102 adjusts to the release position shown in FIG. 5 to release the target 118.

In one embodiment, the strike counter display 108 and action count display 110 are visible while the retention body 102 is holding the target 118. In another embodiment, the strike counter display 108 and the action count display 110 are not visible when target 118 is retained by the retention body 102. In another embodiment, the strike counter display 108 and/or the action count display 110 are not present.

Figure 4:
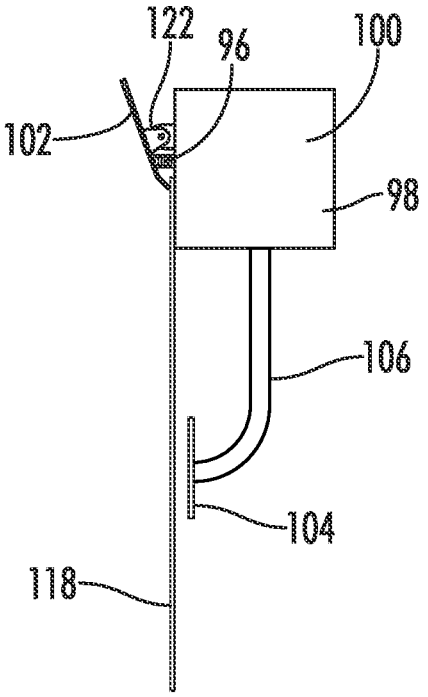
FIG. 4 is a right side view thereof.
Figure 5:
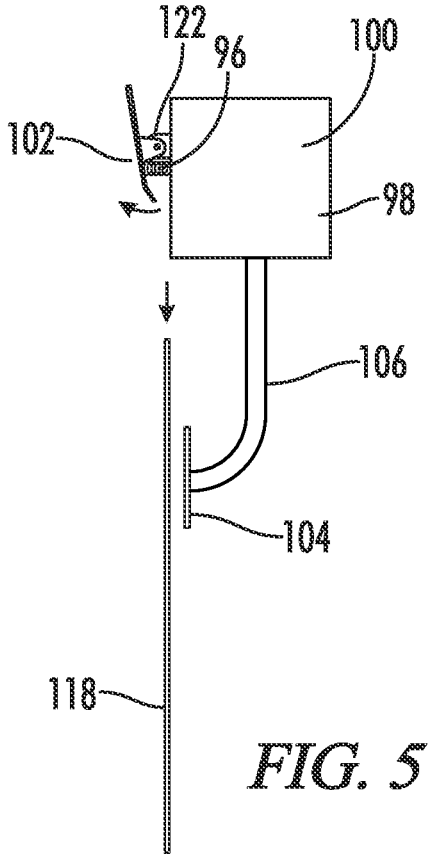
FIG. 5 is a right side view thereof.

The retention body 102 holds the target 118. The shooter/user is located longitudinally forward of the target 118. The strike detector 104 as shown in FIGS. 4 and 5 is located longitudinally behind the target 118. The target 118 is located longitudinally between the shooter/user and the strike detector 104.

The retention body 102 retains the target 118 against the housing 98. The retention body 102 holds the target 118 in an elevated position. The retention body 102 also positions the target 118 for the shooter/user.

The strike detector of one embodiment is sized the same size as the target. The strike detector 102 of one embodiment is sized smaller than the target 118. The strike detector 102 sized smaller than the target encourages the user to aim for a specific area of the target 118. The user positions the strike detector 104 behind the target to define a strike zone 120. The user aims for the strike zone 120 to achieve an action for the device 100. Such action may include releasing the target, providing an audible alert, such as a sound or alarm, and/or providing a visual alert, such as a light or otherwise manipulating the target 118, such as releasing the target, hiding the target, turning the target, rotating the target, or other adjustment of the target.

The strike detector 104 is adjustable in relation to the housing 98. Such adjustability allows customization of the strike zone 120. The user positions the strike detector 104 at a desired position in relation to the target 118. Such positioning focuses the shooter's aim at specific portions of the target 118. The shooter aims at the strike zone 120 to register a hit and to release the target 118 from the housing 98 and the retention body 102.

FIG. 3 shows the strike detector 104 with the target 118 removed. The strike detector 104 in FIG. 2 is located behind the strike zone 120. The shooter aims at a specific portion of the target 118, such as the strike zone 120. The strike detector 104 located behind the target 118 defines the strike zone 120. The neck 106 positions the strike detector 104 in relation to the housing 98 and the retention body 102.

The neck 106 adjusts to different positions in relation to housing 98 and the retention body 102 to change the strike zone 120. The neck 106 maintains the position of the strike detector 104 once the user is finished adjusting the strike zone 120. As discussed above, the neck is rigid, yet malleable, to allow positioning of the strike detector 104 and the strike zone 120 and maintaining the position of the strike detector 104 and the strike zone 120.

The neck 106 allows positioning vertically up and down in relation to the housing 98 and the retention body 102. The neck 106 also allows positioning laterally left and right of the housing 98 and the retention body 104. Such positioning of the strike detector 104 via neck 106 allows the user to define a strike zone 120 and maintain the position of the strike zone 120.

FIGS. 4 and 5 show the side view of the housing 98, strike detector 104, and target 118. The retention body 102 holds the target 118 against the housing 98. Actuator 122 adjusts the positioning of the retention body 102. In one embodiment, the retention body 102 is biased to the retain position shown in FIG. 4. A spring or other biasing device 96 biases the retention body 102 to the retain position. In another embodiment, the actuator 122 places the retention body 102 in the retain position.

The actuator 122 adjusts the retention body 102 between the retain position shown in FIG. 4 and the release position shown in FIG. 5. The retention body 102 shown in FIG. 4 holds the target 118 longitudinally in front of the strike detector 104. The adjustable neck 106 positions the strike detector 104 in relation to the target 118. The neck 106 also maintains the position of the strike detector 104 after adjusting the position. The strike detector 104 defines a strike zone on the target 118. The shooter fires a projectile at the target 118. The projectile passes through the target 118 to the strike detector 104. If the projectile is within the strike zone, the projectile strikes the strike detector 104 after passing the target 118. The controller then counts the hit and increments the strike counter.

If the projectile is not within the strike zone, the projectile does not hit the strike detector 104. Instead, the projectile passes by the strike detector 104. In one embodiment, the neck 106 is covered with a protective covering, such as armor, a shield, Kevlar, or other protection, to limit damage to the neck from projectiles that miss the strike detector 104. In another embodiment, the neck 106 is designed to direct the projectiles downward away from the shooter as a safety measure.

FIG. 5 shows the retention body 102 positioned to the release position. Actuator 122 adjusts the retention body 102 to the release position. In the release position, the retention body 102 releases the target 118. The retention body 102 releases the target 118 from the retention body 102 and the housing 98. The target 118 gravitationally falls away from the housing 98. Releasing the target 118 notifies the shooter that the threat has been neutralized and that the shooter has completed the target or can move to the next target.

The retention body 102 releases the target after a projectile strikes the strike detector 104. In one embodiment, the controller communicates with the strike detector 104. The controller instructs the actuator to either retain the target 118 as shown in FIG. 4 or release the target 118 as shown in FIG. 5. The actuator adjusts the retaining body 102 to the release position shown in FIG. 5 to release the target 118. Otherwise, the actuator maintains the retaining body 102 in the retain position shown in FIG. 4 to secure the target 118.

Figure 6:
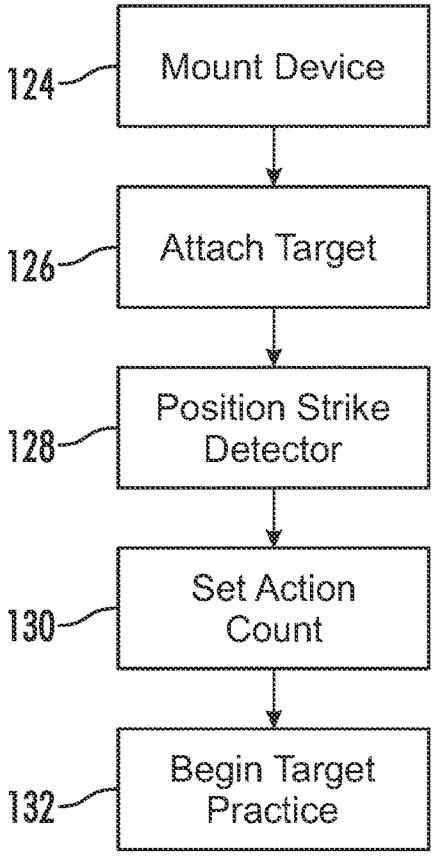
FIG. 6 is a flow chart view showing one embodiment of the present invention.

FIG. 6 shows the process of installing and configuring the target device for target practice. At mount device step 124, a user mounts the housing on to a structure. The user mounts the housing via the mounting apertures as discussed above or with other mounting devices, such as clamps, clips, nails, screws, fasteners, magnets, or other tools to secure the housing. The housing may be mounted on a slide, a bullet trap, a post, a tree, an elevated surface, or other safe area.

The user then attaches the target to the housing via the retention body at Attach Target Step 126. The user opens the retention body to position the target within the retention body. The retention body adjusts to the retain position to hold the target. The user then positions the strike detector at Position Strike Detector Step 128. The user positions the strike detector behind the target at a designated area that the user wants the shooter to direct his/her aim. The positioning of the strike detector defines the strike zone. The neck maintains the position of the strike detector.

The user then establishes the action count defining the number of hits on the strike detector that are required before the actuator releases the target by adjusting the retention body to the release position at Set Action Count Step 130. The user may define the action count to define the number of hits on the strike detector that are required before releasing the target. In another embodiment, the controller may randomly select the action count that defines the number of required hits on the strike detector for releasing the target.

After the target is attached, the strike detector positioned and the action count defined, the user may begin target practice at Begin Target Practice Step 132. The user may begin firing projectiles at the target and the strike detector.

Figure 7:
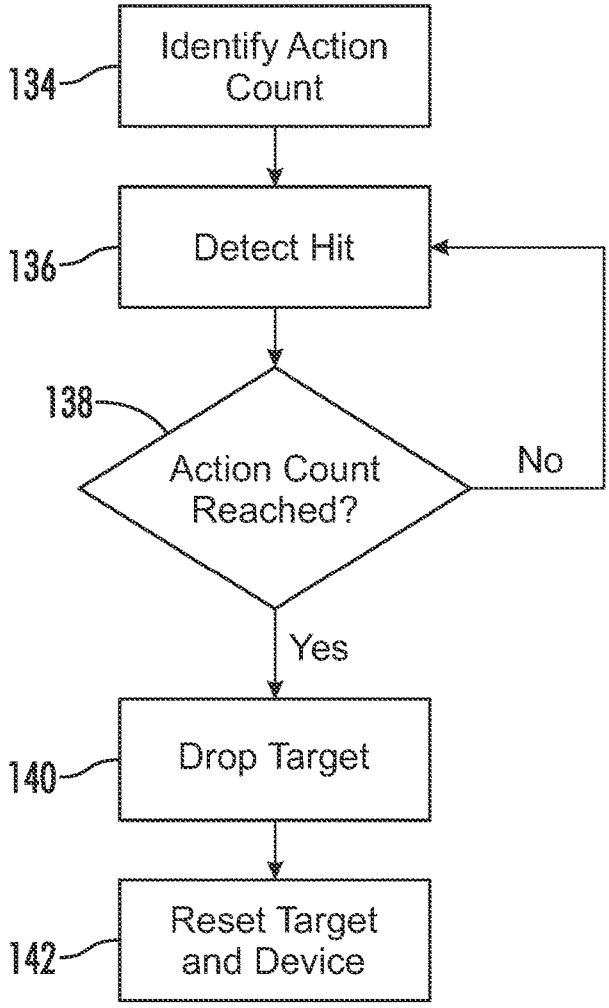
FIG. 7 is a flow chart view showing one embodiment of the present invention.

FIG. 7 shows the process of a target session with the target device. The controller identifies the action count at Identify Action Count Step 134. As stated above, the action count may be defined by the user or randomly assigned. The shooter fires projectiles at the target. The projectile either hits or misses the strike detector. The strike detector detects each hit of the projectile on the strike detector at Detect Hit Step 136. The strike detector registers the hit and communicates with the controller to increment the strike count for each hit of the strike detector.

The controller compares the strike count to the action count to determine if the action count has been reached at Action Count Reached Query 138. If the action count has not been reached, the retention body remains in the retain position. If the action count has been reached at Action Count Reached Query 138, the retention body adjusts to the release position at Drop Target Step 140. The actuator adjusts the retention body to the release position to release the target from the retention body.

After releasing the target, the target device resets at Reset Target and Device Step 142. The controller resets the strike count. The retention body also accepts insertion of a target. The user may reposition the strike detector or leave the strike detector in the same position. The user may also set a new action count or maintain the same action count. The action count can be assigned by the user or randomly assigned.

Figure 8:
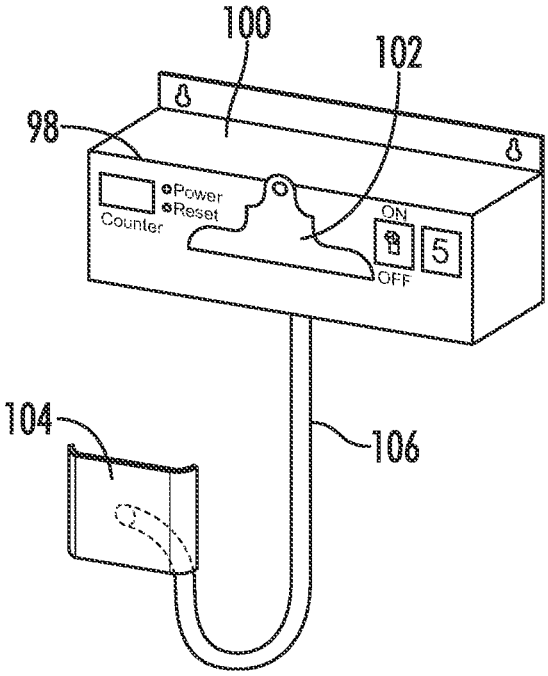
FIG. 8 is a perspective view showing one embodiment of the present invention.

As discussed above, the strike detector 104 may have different shapes depending upon the type of target practice. FIG. 1 shows a planar strike detector. FIG. 8 shows a non-planar strike detector. The non-planar strike detector shown in FIG. 8 provides rearward extensions on the sides that detect shots coming from different angles. Shooters can then fire upon the strike detector at different angles. The rearward extensions extend longitudinally rearward from the front surface of the strike detector 104.

As discussed above, such a strike detector 104 attaches to the housing 98 via neck 106. The target device 100 detects shots from straight on and angled shots from the sides of the device 100. The strike detector 104 with the rearward extensions detect projectiles hitting strike detector. The strike detector 104 communicates with the controller to adjust the actuator and the retention body 102. The controller may require one strike or multiple strikes on the strike detector 104 for releasing the target via the retention body 102.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A target practice device for holding a target and releasing the target after detecting at least one strike by a projectile, the device comprising:

a retention body for holding the target, wherein the retention body adjusts between a release position that releases the target and a retain position that holds the target;

an adjustable strike detector, wherein the strike detector detects strikes of the projectile against the strike detector, wherein the strike detector adjusts in relation to the retention body; and a housing connected to the retention body and the adjustable strike detector, wherein the retention body secures the target to the housing;

wherein the retention body adjusted to the release position releases the target from the housing for detaching the target from the housing.

2. The device of claim 1 further comprising:

a neck attached to the strike detector, wherein the neck adjusts to position the strike detector, wherein the neck maintains positioning of the strike detector after positioning the strike detector.

3. The device of claim 2 further comprising:

a first end of the neck secured to the housing;

a second end of the neck secured to the strike detector, wherein the second end of the neck adjusts in relation to the first end of the neck to position the strike detector in relation to the housing.

4. The device of claim 1 further comprising:

a controller that receives a communication indicating that the projectile hit the strike detector;

an actuator that adjusts the retention body between the retain position and the release position, wherein the controller instructs the actuator to adjust the retention body to the release position after the controller receiving the communication that the projectile hit the strike detector;

wherein the retention body in the release position releases the target;

wherein the retention body in the retain position holds the target.

5. The device of claim 4 wherein the controller requires at least two strikes of the strike detector before instructing the actuator to adjust the retention body to the release position.

6. The device of claim 5 further comprising:

an action count defining a number of times a projectile must hit the strike detector before releasing the target, wherein the action count is greater than one;

a strike count identifying a number of times the strike detector has been hit by a projectile, wherein the strike count is incremented each time the strike detector is hit;

the actuator adjusting the retention body to the release position to release the target after the strike count reaches the action count.

7. The device of claim 6, wherein the action count is defined by a user.

8. The device of claim 6, wherein the action count is randomly generated.

9. A target practice device for holding a target and releasing the target after detecting at least one strike by a projectile, the device comprising:

a retention body for holding the target, wherein the retention body adjusts between a release position that releases the target and a retain position that holds the target an adjustable strike detector, wherein the strike detector detects strikes of the projectile against the strike detector, wherein the strike detector adjusts in relation to the retention body, wherein the strike detector is located longitudinally behind the retention body, wherein the retention body adjusts to the release position after the projectile strikes the strike detector;

an adjustable neck attached to the strike detector, wherein the neck is malleable for adjusting the strike detector laterally and vertically in relation to the retention body, wherein the neck maintains positioning of the strike detector after positioning the strike detector; and a housing connected to the retention body and the neck, wherein the retention body secures the target to the housing;

wherein the retention body adjusted to the release position releases the target to drop the target such that the target is no longer attached to the housing.

10. The device of claim 9 further comprising:

a controller that controls the adjustment of the retention body, wherein the strike detector communicates with the controller to indicate that the projectile hit the strike detector, wherein the controller instructs adjustment of the retention body to the release position after the strike detector communicates that the projectile struck the strike detector.

11. The device of claim 10 further comprising:

an actuator that adjusts the retention body between the retain position and the release position, wherein the controller instructs the actuator to adjust the retention body to the release position upon the controller receiving communication that the projectile struck the strike detector.

12. The device of claim 11 wherein the controller requires at least two strikes of the strike detector before instructing the actuator to adjust the retention body to the release position.

13. The device of claim 12 further comprising:

an action count defining a number of times a projectile must hit the strike detector before releasing the target, wherein the action count is greater than one;

a strike count identifying a number of times the strike detector has been hit by a projectile, wherein the strike count is incremented each time the strike detector is hit;

the actuator adjusting the retention body to the release position to release the target after the strike count reaches the action count.

14. A target practice device for holding a target and releasing the target after detecting at least one strike by a projectile, the device comprising:

a retention body for holding the target, wherein the retention body adjusts between a release position that releases the target and a retain position that holds the target;

an adjustable strike detector, wherein the strike detector detects strikes of the projectile against the strike detector, wherein the strike detector adjusts in relation to the retention body, wherein the strike detector is located longitudinally behind the retention body and the target, wherein the retention body adjusts to the release position after the projectile strikes the strike detector;

a neck attached to the strike detector, wherein the neck adjusts to position the strike detector in relation to the retention body, wherein the neck maintains positioning of the strike detector;

a housing connected to the retention body and the neck, wherein the retention body secures the target to the housing;

a first end of the neck secured to the housing;

a second end of the neck secured to the strike detector, wherein the second end of the neck adjusts in relation to the first end of the neck to position the strike detector in relation to the housing;

wherein the retention body adjusted to the release position releases the target to drop the target such that the target is no longer attached to the housing.

15. The device of claim 14 further comprising:

a controller that controls the adjustment of the retention body, wherein the strike detector communicates with the controller to indicate that the projectile hit the strike detector;

an actuator that adjusts the retention body between the retain position and the release position, wherein the controller instructs the actuator to adjust the retention body to the release position upon the controller receiving communication that the projectile struck the strike detector, wherein the controller maintains the retention body in the retain position if the projectile does not strike the strike detector.

16. The device of claim 15, wherein the controller requires at least two strikes of the strike detector before instructing the actuator to adjust the retention body to the release position;

wherein the controller maintains the retention body in the retain position if the projectile strikes the strike detector, wherein the controller instructs the actuator to adjust the retention body to the release position upon the controller receiving communication of a subsequent strike of the strike detector by a projectile.

* * * * *